US005642631A

United States Patent [19]

Zorini

[11] Patent Number: 5,642,631

[45] Date of Patent: Jul. 1, 1997

[54] CROCHET MACHINE FOR WARP KNITTING WORKINGS AND PROCESS PUT INTO PRACTICE THEREBY

[76] Inventor: Luigi Omodeo Zorini, COMEZ S.p.A.—Via Enrico Fermi 5, Cilavegna (Pavia), Italy

[21] Appl. No.: 647,876

[22] Filed: May 9, 1996

[30] Foreign Application Priority Data

Feb. 6, 1996 [EP] European Pat. Off. ..... 96830050

[51] Int. Cl.[6] ..... D04B 23/00

[52] U.S. Cl. ..... 66/82 R; 66/84 R

[58] Field of Search ..... 66/82 R, 82 A, 66/84 R, 85 R, 204, 87, 88

[56] References Cited

U.S. PATENT DOCUMENTS 3,287,936 11/1966 Bentley et al. ..... 66/82 R
3,435,637 4/1969 Wholton et al. ..... 66/82 R
3,653,230 4/1972 Tosco ..... 66/82 R
4,417,455 11/1983 Durville ..... 66/84 R X
5,544,500 8/1996 Speich ..... 66/85 R

*Primary Examiner*—John J. Calvert
*Attorney, Agent, or Firm*—Laff, Whitesel, Conte & Saret, Ltd.

[57] ABSTRACT

In a crochet machine for warp knitting workings, the vertical oscillations usually imparted to the threading tubes (17) and the eye-pointed needles (11) are replaced by a vertical oscillation imparted to the needles (6) through the needle bar (4). Said needle bar has respective opposite ends fastened to driving arms (8) operated by horizontal-movement means (7) of the needles and in engagement with oscillating supports (26) driven with a vertical reciprocating motion. An idler roller (37) extending between the oscillating supports (26) deviates the article of manufacture (5) coming from the needle bar (4) in a horizontal direction, before the article of manufacture reaches a roller drag unit (35).

15 Claims, 7 Drawing Sheets

CROCHET MACHINE FOR WARP KNITTING WORKINGS AND PROCESS PUT INTO PRACTICE THEREBY

BACKGROUND OF THE INVENTION

1. Field of the Invention

The present invention relates to a crochet machine for warp knitting workings, of the type comprising a bearing base having two side standards, a plurality of needles disposed consecutively in side by side relation along a needle bar extending between the side standards, a plurality of eye-pointed needles disposed consecutively in side by side relation parallelly to the needle bar and in front of the needles and each arranged to engage a respective warp thread, longitudinal-movement means of the needles to impart to the needles a reciprocating movement along their longitudinal extension, and transverse-movement means of the eye-pointed needles to impart to the eye-pointed needles a reciprocating motion substantially parallel to the longitudinal extension of the needle bar.

2. Prior Art

It is known that in warp knitting crochet machines, such as crochet galloon looms, formation of the article of manufacture takes place at a needle bar having a horizontal extension and rigidly supported at the respective opposite ends by two side standards being part of the machine base. Operating on the needle bar is a plurality of needles disposed consecutively in side by side relation and simultaneously reciprocated in the direction of their longitudinal extension. Operating in front of the needles is a plurality of eye-pointed needles disposed consecutively in side by side relation parallelly to the needle bar and supported by a guide bar engaged through the standards so that it can slide and also carry out an angular oscillation on its longitudinal-extension axis. The guide bar is submitted to the combined action of transverse-movement means imparting to the eye-pointed needles a reciprocating motion in a direction parallel to the needle bar and angular-oscillation means by which the eye-pointed needle ends perform a reciprocating motion in a substantially vertical direction, alternately moving to a higher level and a lower level than the needles themselves.

The needle and eye-pointed needle movements are synchronized so that when the needles are at an advanced position towards the eye-pointed needles, the latter are at a raised position and perform a translation movement, each moving from one side to the other of at least one respective needle. During this step the warp thread of each eye-pointed needle is arranged astride the needle, in order to be engaged by the hook-shaped portion provided at the needle end.

When the needles move backward from the advanced position, the warp thread engaged in the hook portion of each needle forms a loop which is guided through the knitting stitch loop formed in the preceding operating cycle, whereas the stitch itself, retained by the needle bar, is discharged from the needle end when said needle is about to reach the end-of-stroke position in its backing off step. Meanwhile, the eye-pointed needles are brought to a slightly lower level than the needles. When the needles are about to be brought back to the advanced position, the eye-pointed needles are translated horizontally in a direction opposite to the horizontal movement previously performed, so that the warp threads form new knitting stitches sliding along the needles during the advancing step thereof. When the needles come close to the advanced position again, the eye-pointed needles again take a slightly higher level than the needles, to start a new knitting cycle.

Cooperation between the needles and eye-pointed needles gives rise to a sequence of knitting stitches, forming a plurality of parallel chains gradually descending from the needle bar.

In most cases, the chains are also interlaced with the weft threads carried by respective threading tubes operating above the needles and disposed consecutively in side by side relation parallelly to the needle bar. The threading tubes are supported by one or more carrier slide bars the opposite ends of which are slidably guided through lifting plates in turn connected to the base standards so as to slide in a vertical direction.

Each carrier slide bar is submitted to the action of respective horizontal-movement means imparting to each threading tube a reciprocating motion parallel to the needle bar extension. In addition, the carrier slide bars are simultaneously set in operation for carrying out a reciprocating oscillation in a vertical direction upon command of a kinematic mechanism acting on the lifting plates.

Operation of the carrier slide bars is coordinated with that of the needles and eye-pointed needles, so that each weft thread is selectively laid down astride one or more needles in order to pass under said needles when the latter reach the return end of stroke and start their advancing movement towards the eye-pointed needles again.

The weft thread placed under the needles will be interlooped into the knitting stitches formed by the warp threads in the subsequent operating cycle.

That being stated, it is pointed out that within the development and improvement scope of the warp knitting machines for meeting the increasing market requirements, many efforts have been made in an attempt to increase the productivity of said machines.

In this connection, devices have been also developed that control the horizontal movement of the individual carrier slide bars by means of respective electric stepping motors, operation of which is managed by an electronic control unit.

Such a control device is described in the European Patent Application EP 0 533 603, in the name of the same inventor.

Operation of the carrier slide bars by stepping-motor control devices has enabled operating speeds even in the order of 1200 rpm to be reached. However, it has been found that, due to the capacity of the stepping-motor control devices, even higher speeds could be reached, also in the light of possible future developments. Furthermore, speeds in the order of 1200 rpm can be achieved only on machines the needle bar of which is of a relatively reduced length, in the order of 400 mm. In knitting machines provided with a longer needle bar, of 600/800 mm for example, the operating speed is to be correspondingly reduced, thereby greatly reducing the productivity difference that these machines would potentially have as compared with those having a shorter needle bar.

It should be also noted that the greatest restrictions are found on those machines that, due to production requirements, are equipped with a great number of carrier slide bars disposed in a fan configuration between the lifting plates, to cause the ends of the respective threading tubes to converge as much as possible close to a common alignment direction.

Based on the above considerations it has been found that presently the greatest constraint to productivity in crochet knitting machines is due to the fact that, at high speeds, the carrier slide bars inevitably tend to bend in the longitudinal extension direction, by effect of the important shakings undergone as a result of the vertical reciprocating movements. These bending deformations bring to an imprecise positioning of the individual carrier slide bars with respect to the needles, and sometimes even to mechanical interferences, which will bring about risks of damages and/or breakages of these components.

Due to the lack of available spaces around the carrier slide bars, appropriate modifications to the structure configuration of said bars aiming at increasing the moment of inertia of same in their longitudinal bending plane, practically cannot be proposed.

In addition, said bending phenomena give rise to several other drawbacks, such as an early and anomalous wear of the bushes designed to guide the carrier slide bar ends through the lifting plates, for example. Another undesired effect of the carrier slide bar deflection is represented by noise, in that at high operating speeds noise tends to reach the limits established by the regulations in force.

SUMMARY OF THE INVENTION

In accordance with the present invention it has been found that all the above drawbacks and limits can be brilliantly overcome by associating appropriate transverse means with the needle bar, which means simultaneously impart to the needles a reciprocating motion in a vertical direction, or in any case in a direction transverse to the needle bar. This transverse movement of the needles lends itself to advantageously replace the reciprocating vertical movement of the threading tubes, and consequently of the carrier slide bars, and preferably also the angular oscillation of the guide bar aiming at alternately bringing the eye-pointed needles to a higher and lower level than the needles.

In more detail, the invention relates to a crochet machine for warp knitting workings, further comprising transverse-movement means of the needles operating on the needle bar to transmit to the needles an alternated "crossing" movement substantially perpendicular to the longitudinal movement of the needles and the transverse movement of the eye-pointed needles, so that the eye-pointed needles with respect to the needles, perform a relative movement circumscribing the longitudinal axes of the needles themselves, by effect of the combination between said crossing movement and said transverse movement of the eye-pointed needles.

Still in accordance with the present invention, this crochet machine puts into practice a new warp knitting process wherein the cyclic execution of the following steps is provided:

disposing at least one needle at an advanced position so that its hooked end is laterally offset and at a lower level than a corresponding eye-pointed needle carrying a warp thread, translating the eye-pointed needle laterally to arrange the warp thread above the needle, moving the needle backward from the advanced position to engage the warp thread into the hooked end of the needle and to subsequently throw off from the needle end one knitting stitch formed in a preceding work cycle, raising the needle to a higher level than the eye-pointed needle, imparting a return side translation to the eye-pointed needle in a direction opposite to the preceding side translation step, bringing the needle back to the advanced position during the return side translation of the eye-pointed needle, lowering the needle again to a lower level than the eye-pointed needle.

BRIEF DESCRIPTION OF THE DRAWINGS

Further features and advantages will become more apparent from the detailed description of a preferred embodiment of a crochet machine for warp knitting workings, and a warp knitting process put into practice thereby, in accordance with the present invention, given hereinafter, by way of non-limiting example, with reference to the accompanying drawings, in which.

DESCRIPTION OF THE PREFERRED EMBODIMENT

Figure 1:
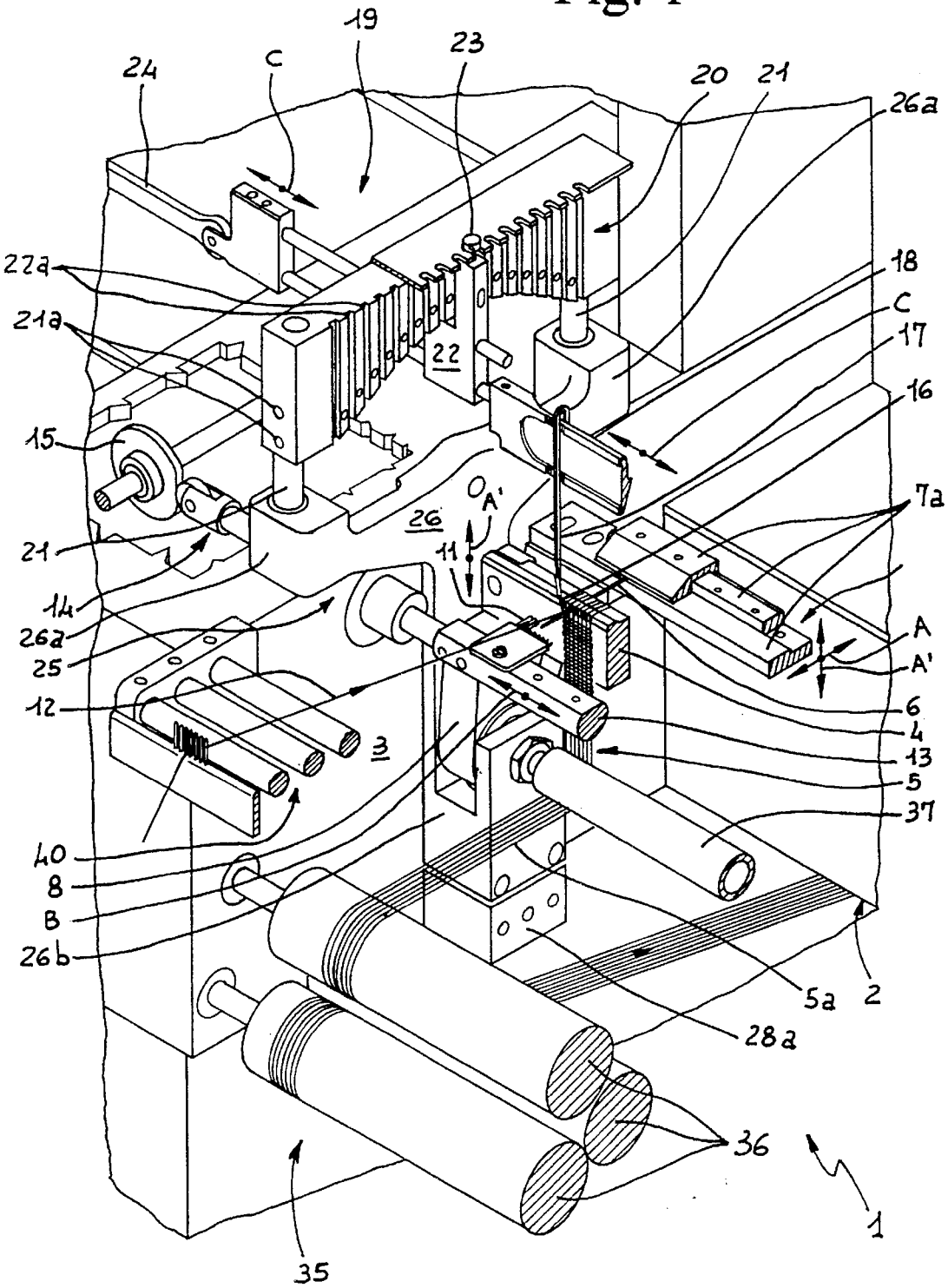
FIG. 1 is a fragmentary perspective view partly in section of a crochet machine for warp knitting workings made in accordance with the present invention.
Figure 2:
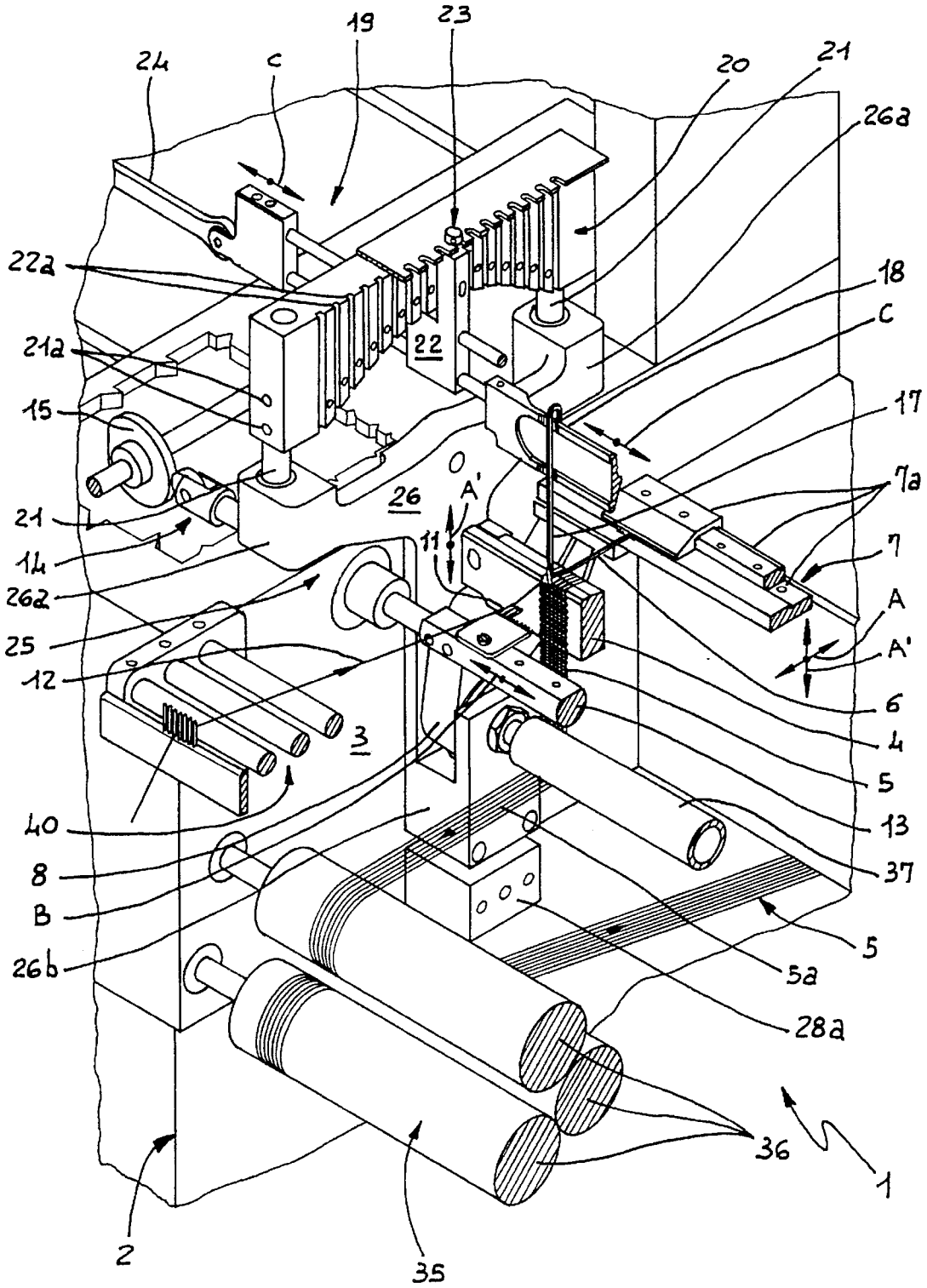
FIG. 2 is a similar view of the crochet machine in a different operating step.

With reference to the drawings, a crochet machine for warp knitting workings in accordance with the invention has been generally identified by reference numeral 1.

The knitting machine 1 comprises a base 2 provided with two side standards 3 between which at least one needle bar 4 horizontally extends, at a front edge 4*a* of which the sequential interlacing of the knitting threads takes place, as better clarified in the following, for the purpose of forming an article of manufacture 5.

Slidably guided on the needle bar 4 is a plurality of knitting needles 6 disposed consecutively in side by side relation and operated by longitudinal-movement means 7 of the needles, adapted to transmit a reciprocating movement to the needles themselves along the longitudinal extension of same, preferably in a horizontal direction and at all events in a direction perpendicular to the longitudinal extension of the needle bar 4, as shown by arrow "A".

In particular, the needle longitudinal-movement means 7 is essentially comprised of at least one secondary needle bar 7*a* rigidly engaging the rear ends 6*a* of needles 6 and rigidly supported, at the respective opposite ends, between a pair of driving arms 8 (only one of which is shown in the figures) oscillatably engaged according to a common oscillation axis parallel to the needle bar 4 and lying in a plane perpendicular to the longitudinal extension of the needles 6. The driving arms 8 are submitted to the simultaneous action of respective longitudinal-movement connecting rods 9 each having one end 9*a* pivotally mounted to the corresponding driving arm 8 and a second end operatively in engagement with a longitudinal-movement eccentric 10 of the needles that, in a manner known per se, receives movement from the main shaft of the knitting machine (not shown in the drawings), through an appropriate kinematic transmission gear.

In addition, a plurality of eye-pointed needles 11 is disposed consecutively in side by side relation parallelly to the needle bar 4, between the side standards 3, so that said eye-pointed needles are located before the front hooked ends 6*b* of needles 6.

Each of the eye-pointed needles 11 engages, through an eye 11*a*, a respective warp thread 12 coming from a creel or supply beam through conventional guide means 40, to suitably dispose it into the front hooked end 6*b* of at least one respective needle 6 for the purpose of forming knitting stitches.

In known manner, the eye-pointed needles 11 are fastened to a guide bar 13 parallel to the needle bar 4 and slidably guided through the standards 3 at the respective opposite ends. The guide bar 13, preferably restrained from rotation about its own longitudinal axis, is submitted to the action of transverse-movement means 14 of the eye-pointed needles which is adapted to transmit a reciprocating motion according to arrow "B" to the eye-pointed needles 11, which movement is substantially parallel to the longitudinal extension of the needle bar 4. To this end, the eye-pointed needle transverse-movement means 14, in a manner known per se, can consist of a cam 15 housed in one of the side standards 3 and acting on a corresponding end of the guide bar 13, against the action of return spring means not shown as known.

Figure 3:
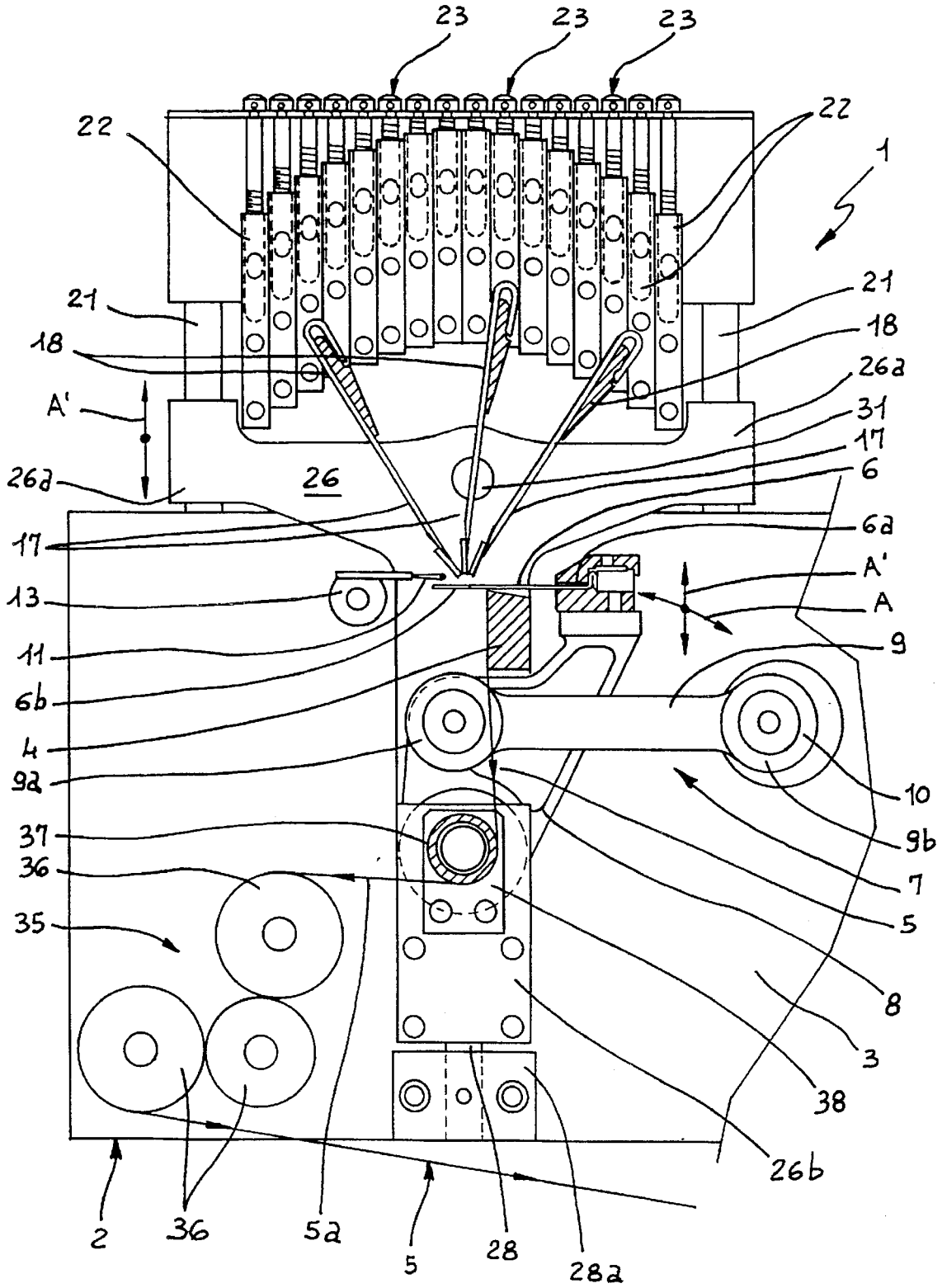
FIG. 3 is a fragmentary sectional view taken along a vertical plane parallel to the needle bar.

The ward threads 12 brought close to the needles 6 through the eye-pointed needles 11, are ready to be interlaced, for making the article of manufacture 5, with the weft threads 16 in turn engaged through respective threading tubes 17, disposed consecutively in side by side relation parallelly to the needle bar 4, above the needles 6. In a manner known per se, the threading tubes 17 are engaged on respective carrier slide bars 18, the number of which can vary, depending on the type of working to be carried out. When a plurality of carrier slide bars 18 is provided, said bars and the respective threading tubes 17 are disposed according to a fan-shaped configuration in cross section, so that the lower ends of the corresponding tubes 17 converge as much as possible on the vicinity of the needles 6, as clearly viewed from FIG. 3.

Transverse-movement means 19 of the threading tubes operates on each carrier slide bar 18 to transmit to the threading tubes 17 a reciprocating movement "C" parallel to the longitudinal extension of the needle bar 4. To this end, each carrier slide bar 18 is slidably guided, in a direction parallel to the needle bar 4, through guide plates, only one of which is shown in the drawings and is generally denoted by 20, and each of them being fastened to one of the standards 3 of base 2. In more detail, each guide plate 20 is connected at the upper part thereof with the respective standard 3 by a pair of guide columns 21, the guide plate being fastened to the top of said columns by headless screws 21*a* or equivalent locking means.

In the embodiment shown each guide plate 20 is also provided to engage the corresponding ends of the carrier slide bars 18 by means of blocks 22 to be positioned along vertical grooves 22*a* provided in the plate itself, upon command of an adjusting screw 23 or similar adjustment means in order to set the distance of the individual threading tubes from the needles 6.

The threading-tube transverse-movement means 19 also provides that each carrier slide bar 18 be submitted to the action of a drive device, not shown as known per se, that carries out a reciprocating motion of the corresponding bar 18, by means of a connecting rod 24 or equivalent means, so as to transmit the horizontal reciprocating movement to the corresponding threading tubes 17. The horizontal-movement devices of the individual carrier slide bars 18, not shown as known per se and not of importance to the ends of the invention, can be of the type providing a "Glider" chain or a stepping motor, as described in the European Patent Application No. EP 0533630.

In accordance with the present invention, needles 6, in addition to said longitudinal movement according to arrow "A", are also given an alternated movement in a vertical direction or at all events in a direction substantially perpendicular to the longitudinal movement "A" of the needles themselves and the transverse movements "B" and "C" of the eye-pointed needles 11 and threading tubes 17.

In the progress of the present description this vertical movement, denoted by arrows "A'", is called "crossing movement" because, as better shown in the following, it is exactly by effect of this movement that the weft threads 16 and warp threads 12 can alternately pass above and below the longitudinal axes of needles 6 so as to form knitting stitches in the warp threads 12 and to interloop the weft threads 16 into the formed knitting stitches.

This alternated crossing movement is achieved by transverse-movement means of the needles generally identified by 25, preferably operating on the needle bar 4.

Figure 4:
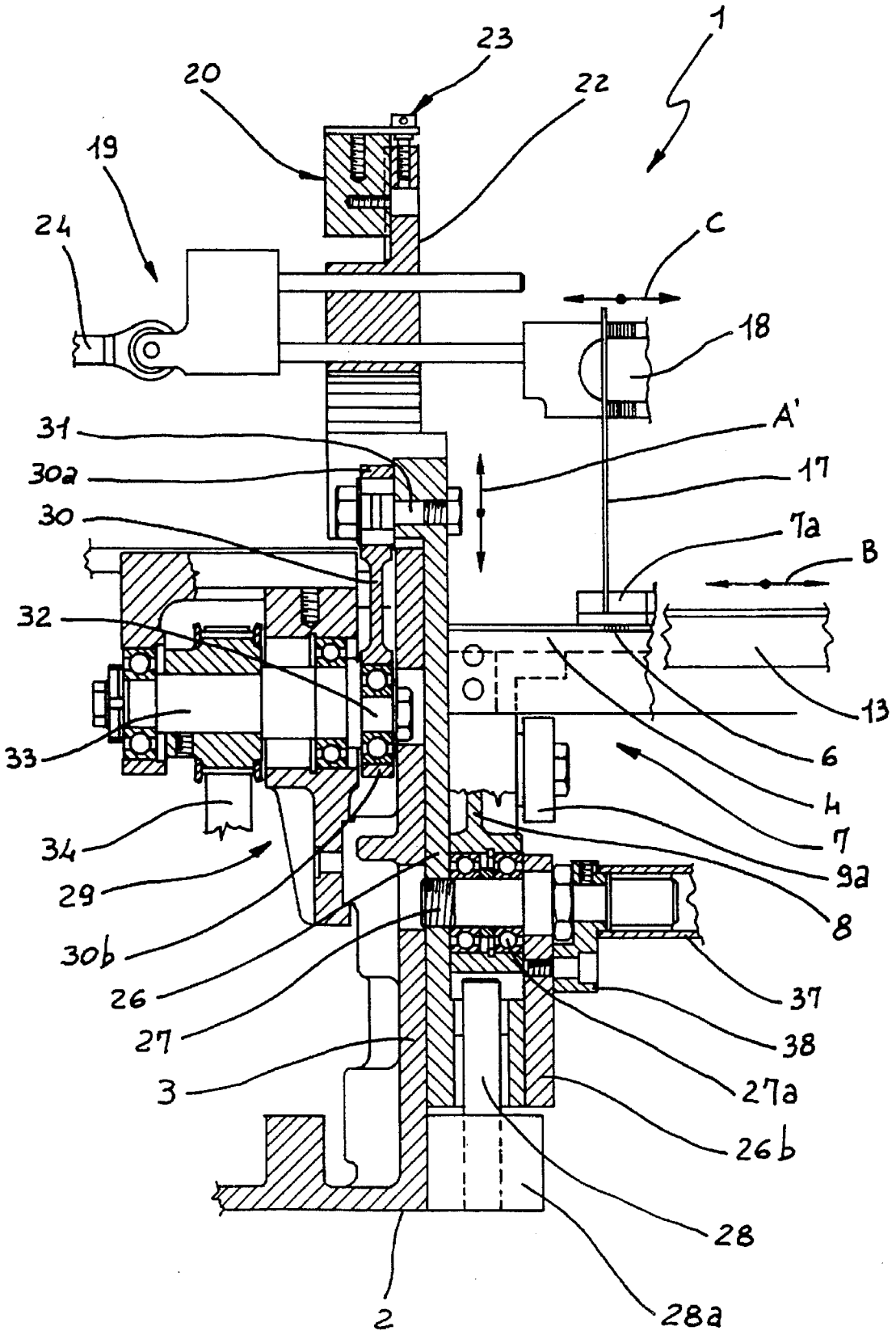
FIG. 4 shows the crochet machine sectioned along an intermediate vertical plane between the base standards.

The needle transverse-movement means 25 essentially comprises a pair of oscillating supports 26 each of which is connected to a respective end of the needle bar 4. In more detail, engagement between each oscillating support 26 and the corresponding end of the needle bar 4 is accomplished with the aid of one of the above mentioned driving arms 8, the latter being oscillatably in engagement with the oscillating supports 26 by means of connecting pins 27 provided with respective bearings 27*a* (FIG. 4).

Each oscillating support 26 is slidably guided on the corresponding side standard 3 is a vertical direction or in any case in a direction parallel to the crossing movement "A'" to be imparted to the needles 6. To this end, each oscillating support 26 is provided to preferably have a substantially T-shaped configuration, the two upper side webs 26*a* of which are slidably engaged through the guide columns 21 rigidly supporting the corresponding guide plate 20, while the central lower portion 26*b* is slidably guided along an auxiliary guide column 28 standing from a block 28*a* fastened in cantilevered fashion to the corresponding standard 3.

The needle transverse-movement means 25 further comprises an actuation unit 29 (FIG. 4) operating on the oscillating supports 26 to simultaneously set them in operation with a reciprocating motion along the side standards 3. This actuation unit 29 essentially comprises at least one pair of driving connecting rods 30 each having one end 30*a* connected to one of the supports 26 by a pin 31, and a second end 30*b* operatively connected to an eccentric 32 driven in rotation, preferably about an axis parallel to the needle bar 4, by a drive shaft 33 operated by a toothed belt 34 in turn driven by the main shaft of the machine. In the accompanying drawings, the actuation unit 29 is shown only partly, with reference to the members provided for operation of one of the oscillating supports 26, because the members intended for operation of the other oscillating support are identical with, and arranged in a mirror image of those shown in the figure.

The crossing movement "A'" imparted to the needles 6 is such that, by effect of combining this movement with the transverse movement "B" of the eye-pointed needles 11, said eye-pointed needles with respect to the needles 6, perform a relative movement circumscribing the longitudinal axes of said needles.

In addition, combining of the crossing movement "A'" with the transverse movement "C" of the threading tubes 17 makes the latter perform, still with respect to the needles, a relative movement extending astride the needles.

As a result, the relative movement between the needles 6, eye-pointed needles 11 and threading tubes 17 is substantially unchanged compared with what happens in known machines, in spite of the fact that the vertical movements imparted in the known art to the threading tubes 17 and eye-pointed needles 11 have been replaced, in accordance with the present invention, by the crossing movement "A'" transmitted to the needles 6.

Therefore, interlooping of the weft threads 16 with the warp threads 12 to form the article of manufacture 5 takes place in the same manner as in the known art, though in accordance with a new knitting process originally providing lifting and lowering steps of the needles 6 alternated with the longitudinal movements of the needles themselves and the transverse movements of the eye-pointed needles 11 and threading tubes 17.

Figure 6:
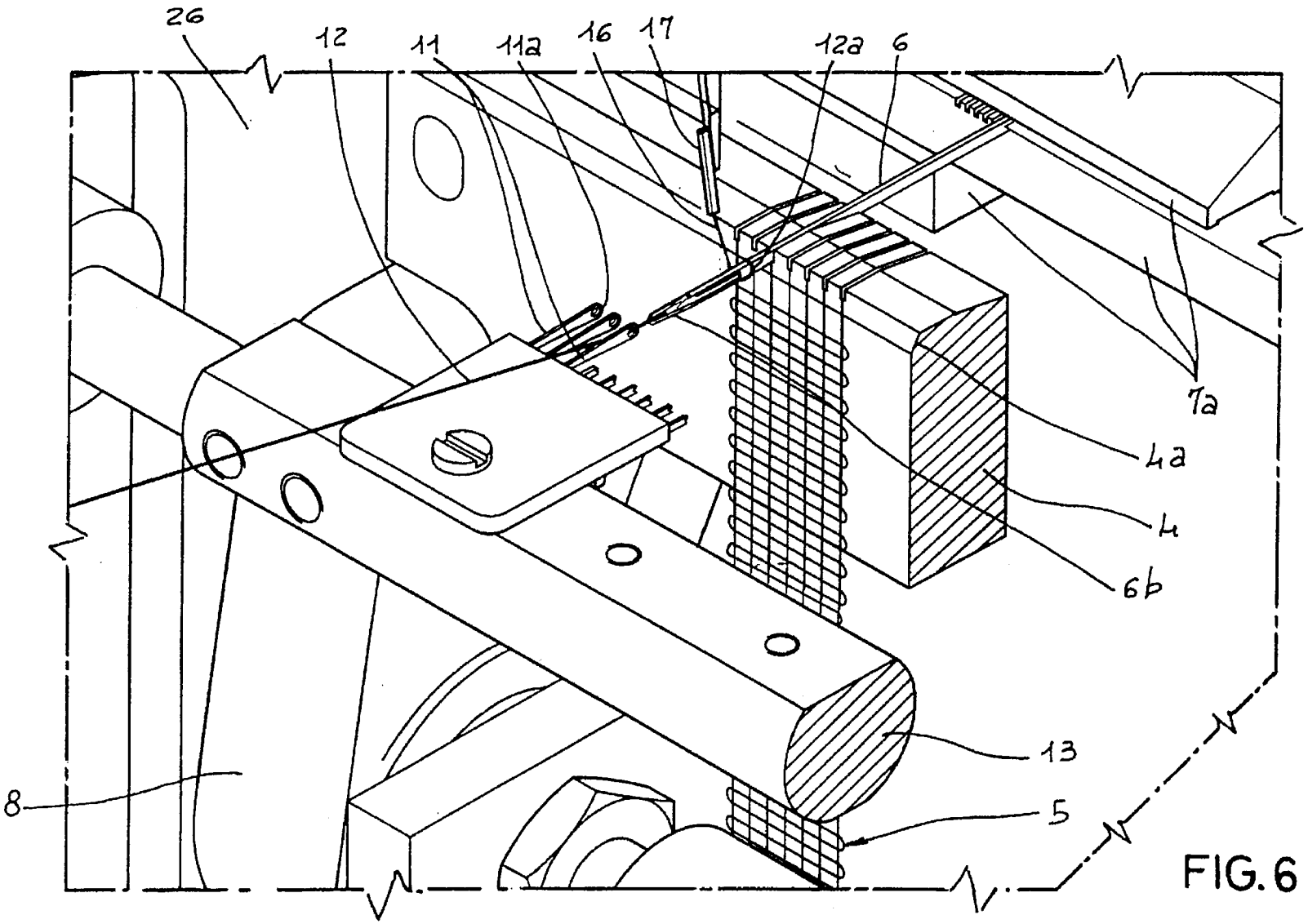
FIG. 6 is a perspective view similar to FIG. 5, with the knitting members in a subsequent operating step.
Figure 7:
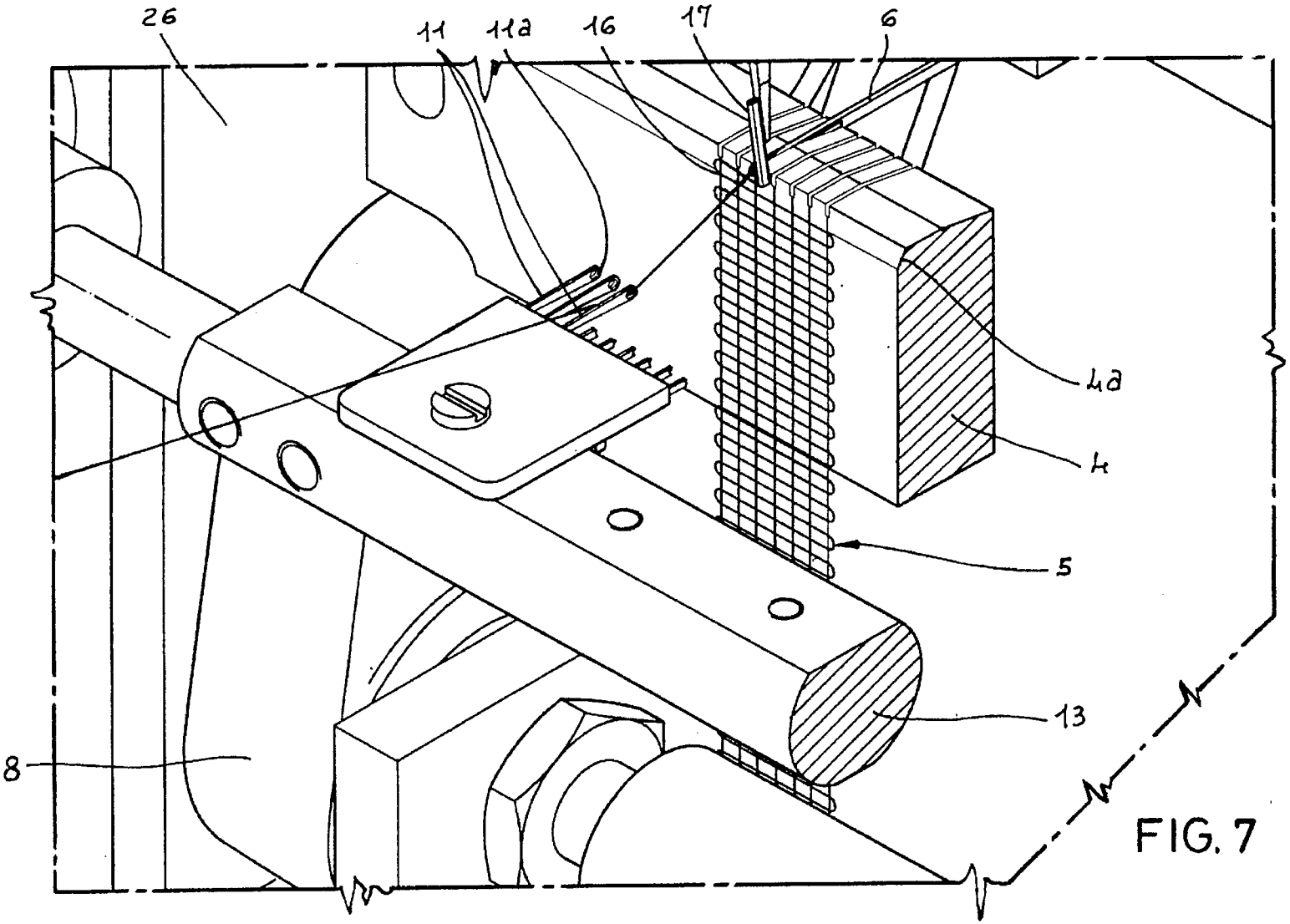
FIG. 7 is a perspective view similar to FIGS. 5 and 6, with the knitting members disposed for carrying out the operating step shown in FIG. 2 which is subsequent to the one shown in FIG. 6.

For the sake of clarity , a sequence of the operating steps performed in accordance with the knitting process put into practice by the machine of the invention is set forth hereinafter, with reference to FIGS. 5, 6 and 7.

For better understanding, in these figures interlacing of a weft thread 16 with a warp thread 12 is represented in connection with one needle 6, one eye-pointed needle 11 and one threading tube 17, although actually knitting involves a simultaneous interlacing of several weft threads with the respective warp threads.

Figure 5:
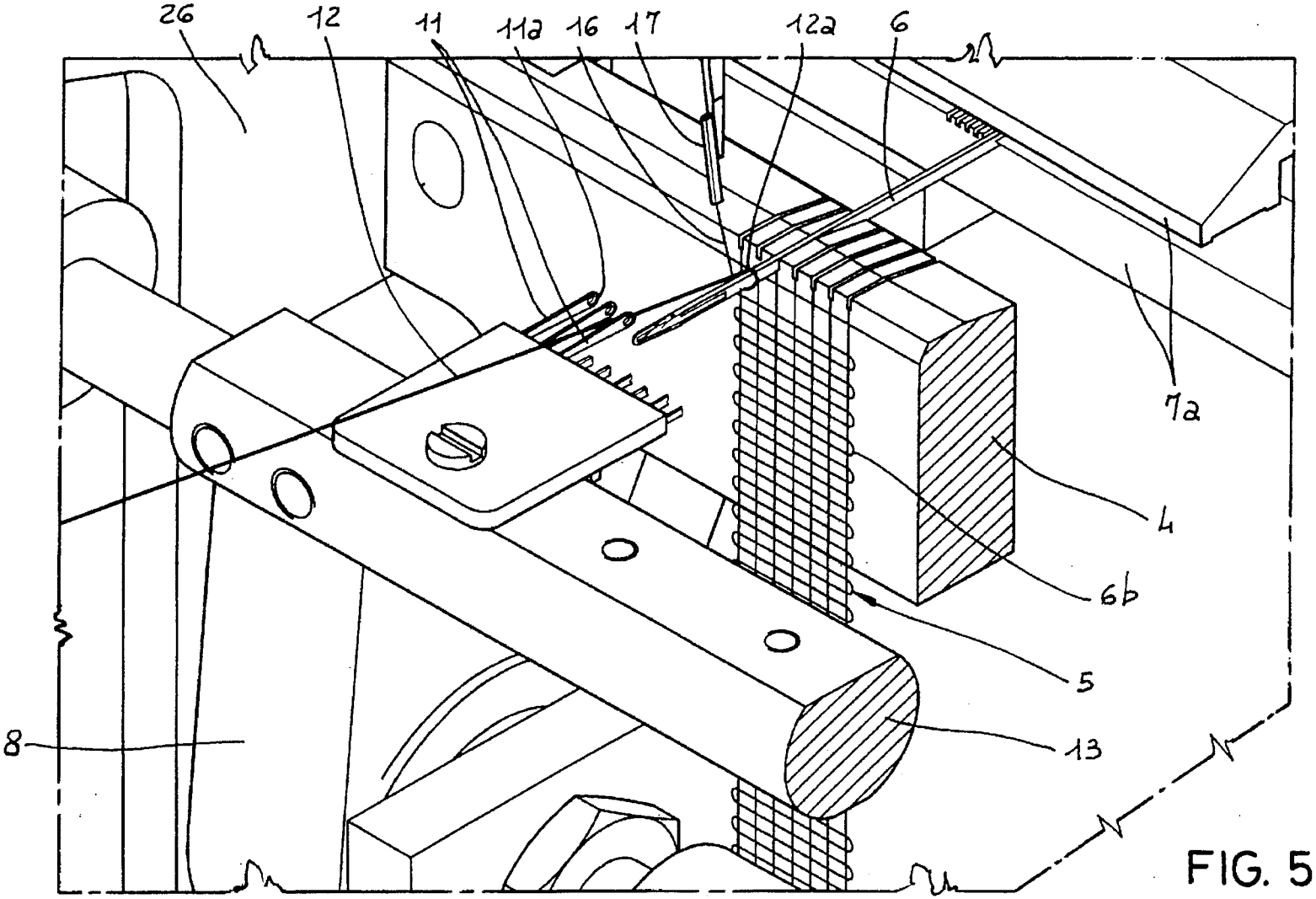
FIG. 5 shows a detail of FIG. 1 to an enlarged scale, emphasizing the cooperating knitting members during a first operating step of the warp knitting process.

That being stated, FIG. 5 shows an operating step in which the needle 6 is located at an advanced position relative to the needle bar 4, so as to bring its hook-shaped end **6*b* to a laterally offset position relative to the corresponding eye-pointed needle 11. In this step, the needle bar 4 is located at the lower dead point of the crossing movement "A'", so that the hooked end 6*b* of needle 6 is located at a lower level than the eye-pointed needle 11. Starting from this position, the eye-pointed needle 11 is laterally translated upon command of the cam 15 passing from one side to the other of needle 6, so that the warp thread 12 passing through the eye 11*a* and already interlaced with the article of manufacture 5 in the preceding stitch formation cycle, is put astride the needle 6. Concurrently with or immediately after the lateral translation of the eye-pointed needle 11, the needle 6 is moved backward from the advanced position, upon command of the eccentric 10 operating on the connecting rod 9 carrying out the longitudinal movement of the needles. In this step, the warp thread 12 engages in the hooked portion 6*b* as shown in FIG. 6. As said backing step goes on, a knitting stitch 12*a* previously formed around the needle 6 in a preceding work cycle is obliged to slide along the needle until it is completely disengaged from the hooked end 6B and immediately falls below the needle. Concurrently with the needle backward movement, or when the needle comes close to the backward end of stroke, the needle bar 4 is raised upon command of the actuation unit 29 so that the needle 6, close to the backward end of stroke is disposed at a higher level than the eye-pointed needle 11, as shown in FIG. 7. In this step, the needle 6 also is at a slightly raised position relative to the lower end of the threading tube 17**, to the ends better specified in the following.

As the needle is in this raised position, the eye-pointed needle 11 is laterally translated in a direction opposite to that of the preceding lateral translation step, while the needle is brought back to the advanced position.

Under this situation, the warp thread 12 is disengaged from the hooked end **6*b* sliding astride the needle 6, whereas the eye-pointed needle 11** leads it to be wound also over the underside of the needle so as to form a new loop that will constitute the subsequent knitting stitch.

Concurrently with the needle forward movement or at the end of this step, the needle bar 4 performs a descending vertical shifting so that the needle, on reaching the advanced position, is at a lower level than the eye-pointed needle 11 and a new stitch formation cycle is started.

The cyclic repeating of the above listed steps gives rise to the formation of one or more chains, of same number as the warp threads 12, which are interlaced with each other or not, depending on the number of needles that are loaded with the warp thread by each individual eye-pointed needle.

For picking of the weft thread 16 into the chains formed by the warp threads 12, the threading tube 17 is translated, before the needle 6 are brought back to the advanced position, parallelly to the needle bar 4, that is perpendicularly to the back and forth movement of the needles themselves, to lay down the weft thread 16 in such a manner that the needles 6, brought back to the advanced position, are subjected to pass over it. In particular, the threading tube 17 is normally provided to perform its displacement over the needles 6 when said needles are about to be moved backward before reaching the return end of stroke. The weft thread 16 is then laid down over the needles 6, to slide along the same and fall from the hooked ends **6*b* when the needles reaching the return end of stroke are raised above the lower end of the threading tube 17**.

Alternatively, the threading tube movement can take place during the reversal step of the needle movement at the return end of stroke. In this case, the weft thread 16 is directly laid down at a lower level than the hooked ends **6*b* of needles 6**.

The laid down weft thread 16 will be interlaced into the knitting stitches formed by the warp threads 12 in the subsequent operating cycle.

The article of manufacture 5 being produced as above described is guided away from the needle bar 4 passing through a drag unit 35 that, in the embodiment shown, comprises three power-driven rollers 36 over which the article of manufacture is alternately wound. In a manner known per se, the rollers 36 are driven in rotation in synchronism with operation of the knitting machine 1 so that the article of manufacture 5 is dragged along at a speed corresponding to the article formation speed close to the needle bar 4.

In an original manner, at an intermediate position between the needle bar 4 and drag unit 35, the article of manufacture 5 is provided to be also wound over at least one intermediate element 37 fastened parallelly of the needle bar 5. In more detail, this intermediate element 37 in the example shown is essentially comprised of an idler roller the opposite ends of which are rotatably mounted to the oscillating supports 26 by means of interconnecting elements 38 fastened to the oscillating supports themselves. Advantageously, the idler roller 37 is such positioned that, by effect of its presence, the article of manufacture 5 over a portion **5*a* thereof extending between the intermediate element and the drag unit 35, is deviated in a direction substantially perpendicular to the crossing movement "A'". In this manner the risk that the article of manufacture may undergo undesired repeated tensioning actions due to the vertical crossing movement "A'" imparted to the needle bar 4 and needles 6** is eliminated.

Still for the purpose of avoiding undesired tensioning actions in the article of manufacture 5, preferably each of the longitudinal-movement connecting rods 9 will extend perpendicularly to the movement direction of the oscillating supports 26, and the driving arms 8 will be pivotally mounted in an oscillatable manner to the oscillacting supports according to a common pivot axis parallel to the needle bar 4 and lying in a plane normal to the longitudinal extension of needles 6.

The present invention attains the intended purposes and achieves important advantages.

Since it is no longer necessary to impose the vertical reciprocating movement to the carrier slide bars 18, all problems that in the known art originated from deflexion undergone by the carrier slide bars when forced to work at a high operating speed are eliminated. In the machine according to the invention, the only reciprocating motion imparted to the carrier slide bars is directed along the longitudinal extension of same and, therefore, does not give rise to any bending stresses by effect of the concerned inertias. As a result, it is potentially possible to operate the knitting machine at a speed far higher than the limits hitherto reached without involving problems of mechanical interferences between the threading tubes and the knitting needles.

It should be also noted that the invention brings about an important structural simplification in warp knitting machines, in that the vertical oscillations that up to now had to be distinctly imparted to the threading tubes and the eye-pointed needles, are now replaced by the only vertical movement of the needles through the needle bar. Obviously, the eye-pointed needles are not inhibited from being also provided with a vertical reciprocating movement of their own, when particular working requirements are to be met, which vertical reciprocating movement can be obtained by conventional kinematic mechanisms transmitting to the guide bar an alternating oscillation about its own longitudinal axis.

The available spaces around the needle bar and generally around all construction components extending between the oscillating supports 26, offer a complete freedom of planning for selection of the most appropriate configurations to be given to these components. As a result, these components will be able to have the maximum moment of inertia in the vertical plane in which the crossing movement "A'" takes place, and therefore will not be affected by bending stresses induced by the concerned inertias even when the operating speed of the machine is high and the needle bar is of an important length.

The absence of bending deformations on the carrier slide bars also eliminates the early and anomalous wear phenomena that in the known art can be found on the guide bushes of the bars themselves arranged in the corresponding guide plates, and greatly reduces the operating noise of the knitting machines in general.

It should be also recognized that the machine according to the invention can be also implemented by suitably modifying the already existing machines.

In fact, columns 21 intended for guiding the oscillating supports 26 can be also embodied by the same columns that, in the conventional machines, guide the vertical movements of the guide plates of the carrier slide bars. Likewise, the actuation unit 29 of the oscillating supports 26 can be directly obtained by the kinematic mechanisms that in the new machines act on the guide plates to control the vertical oscillation of the carrier slide bars.

Obviously, many modifications and variations can be made to the invention as conceived, without departing from the inventive idea characterizing it. In particular the machine in reference can be equipped with needles of any type, usually employed in crochet machines. In addition, the innovatory principles proposed by the invention can be used to advantage also in warp knitting crochet machines devoid of carrier slide bars, that is set up for producing manufactured articles obtained only through interlacing of the chains formed by the warp threads, for example.

I claim:

1. A crochet machine for warp knitting workings, comprising:

a bearing base (2) having two side standards (3);

a plurality of needles (6) disposed consecutively in side by side relation along a needle bar (4) extending between the side standards (3) each needle having a longitudinal axis;

a plurality of eye-pointed needles (11) disposed consecutively in side by side relation parallelly to the needle bar (4) and in front of said plurality of needles (6), and each of the eye-point needles arranged to engage a respective warp thread (12);

needle longitudinal-movement means (7) to impart a reciprocating movement ("A") to the plurality of needles (6) along a longitudinal extension; and eye-pointed needle transverse-movement means (14) to impart to the eye-pointed needles a reciprocating motion ("B") substantially parallel to the longitudinal extension of the needle bar (4), further comprising needle transverse-movements means (25) to transmit to the plurality of needles (6) an alternated crossing movement ("A'") substantially perpendicular to the longitudinal movement ("A") of the plurality of needles (6) and the transverse movement ("B") of the eye-pointed needles (11), such that the eye-pointed needles, with respect to the plurality of needles, perform a relative movement circumscribing the longitudinal axes of the plurality of needles themselves, through a combination of the crossing movement ("A'") and the transverse movement ("B") of the eye-pointed needles.

2. The machine as claimed in claim 1, further comprising:

a plurality of threading tubes (17) disposed consecutively in side by side relation parallelly to the needle bar (4) above the plurality of needles (6) and each of said tubes arranged to engage a respective weft thread (16);

threading tube transverse-movement means (19) to transmit to the threading tubes (17) a reciprocating movement ("C") parallel to the longitudinal extension of the needle bar (4), so that the threading tubes (17), with respect to the needles (6), perform a relative movement extending astride the needles themselves, through a combination of the crossing movement ("A'") and the transverse movement ("C") of the threading tubes (17).

3. The machine as claimed in claim 1, wherein said needle transverse-movement means (25) comprises:

a pair of oscillating supports (26) each of which is connected to a respective end of the needle bar (4) and slidably guided on one of said side standards (3), parallelly to the crossing movement ("A'");

an actuation unit (29) operating on said oscillating supports (26) to simultaneously move the supports with a reciprocating motion along the side standards (3).

4. The machine as claimed in claim 3, wherein said actuation unit (29) comprises a pair of driving connecting rods (30) each having one end (**30*a*) connected to one of said oscillating supports (26) and a second end (30*b*) operatively in engagement with an eccentric (32**) driven in rotation.

5. The machine as claimed in claim 3, wherein said needle longitudinal-movement means (7) comprises:

at least one auxiliary needle bar (**7*a*) extending parallelly to said needle bar (4) and rigidly engaging the plurality of needles (6) on a side of the auxiliary needle bar facing away from the eye-pointed needles (11**);

a pair of driving arms (8) oscillatably in engagement with said oscillating supports (26);

a pair of longitudinal-movement connecting rods (9) each having one end (9*a*) connected to one of the driving arms (8) and a second end (9*b*) connected to a longitudinal-movement eccentric (10).

6. The machine as claimed in claim 5, wherein each of said longitudinal-movement connecting rods (9) extends substantially perpendicular to the movement direction of the oscillating supports (26).

7. The machine as claimed in claim 1, further comprising a drag unit (35) for an article of manufacture (5) extending downstream of the plurality of needles (6), further comprising at least one intermediate element (37) fastened parallelly of the needle bar (4) and engaging the article of manufacture (5) to deviate it in a direction substantially perpendicular to the crossing movement ("A'") over a portion (5') of the article extending between the intermediate element (37) and said drag unit (35).

8. The machine as claimed in claim 7, wherein said intermediate element (37) comprises an idler roller having respective opposite ends rotatably engaged with said oscillating supports (26).

9. The machine as claimed in claim 5, wherein the driving arms are pivotally mounted in an oscillatable manner to the respective oscillating supports (26) according to a common pivot axis lying in a plane normal to the longitudinal extension of the needles (6).

10. The machine as claimed in claim 2, wherein the threading tubes (17) are linked to at least one carrier slide bar (18) slidably guided, in a direction parallel to the needle bar (4), through guide plates (20) fastened to one of the side standards (3).

11. The machine as claimed in claim 10, wherein said guide plates (20) are fastened to the respective side standards (3) by guide columns (21) slidably engaging said oscillating supports (26).

12. A warp knitting process carried out by a crochet machine, wherein a cyclic execution of the following steps is provided:

disposing at least one needle (6) at an advanced position so that a hooked end thereof (6*b*) is laterally offset and at a lower level than a corresponding eye-pointed needle (11) carrying a warp thread (12);

translating the eye-pointed needle (11) laterally to arrange a warp thread (12) above the needle (6);

moving the needle (6) backward from the advanced position to engage the warp thread (12) into the hooked end (6*b*) of the needle and to subsequently cast off from an end of the needle one knitting stitch (12*a*) formed in a preceding work cycle;

raising the needle (6) to a higher level than the eye-pointed needle (11);

imparting a return side translation to the eye-pointed needle (11) in a direction opposite to a preceding side translation step;

returning the needle (6) to the advanced position during the return side translation of the eye-pointed needle (11);

lowering the needle (6) to a lower level than the eye-pointed needle (11).

13. The process as claimed in claim 12, wherein before the returning stop providing a step of translating a threading tube (17), carrying a weft thread (16) perpendicularly to a back and forth direction of the needle (6), in order to lay down weft thread (16) over which the needle returned to the advanced position passes.

14. The process as claimed in claim 13, wherein the threading tube (17) translation is carried out during the backing step of the needle (6) from the advanced position, so that the weft thread (16) is laid down over the needle (6) before the needle is brought to a higher level than the eye-pointed needles (11).

15. The process as claimed in claim 13, wherein the threading tube (17) translation is carried out after the needle (6) has been moved backward from the advanced position and brought to a higher level than the eye-pointed needle (11).

* * * * *